United States Patent [19]

Kinka et al.

[11] Patent Number: 5,000,705

[45] Date of Patent: Mar. 19, 1991

[54] ELECTRICAL CABLE CONNECTION DEVICE

[75] Inventors: Andrew J. Kinka, Pottstown; Walter M. Werner, Downingtown, both of Pa.

[73] Assignee: AMP Incorporated

[21] Appl. No.: 490,176

[22] Filed: Mar. 8, 1990

[51] Int. Cl.[5] ..... H01R 11/09

[52] U.S. Cl. ..... 439/797; 439/791; 439/805; 439/807; 439/811

[58] Field of Search ..... 439/791, 796, 797, 805, 439/807, 810–812

[56] References Cited

U.S. PATENT DOCUMENTS

| | | | |
|---|---|---|---|
| 2,076,209 | 4/1937 | Rowe | 439/810 |
| 4,795,365 | 1/1989 | Johnston et al. | 439/807 |
| 4,863,403 | 9/1989 | Shannon | 439/807 |

*Primary Examiner*—Paula A. Bradley

[57] ABSTRACT

An electrical cable connection device (10) for use in splicing a pair of cables or teminating a single cable has been disclosed. More particularly, the device (10) includes a body member (12), wedge (14) and bolt (16). An axial passage (22) through the body member for receiving the end of the cable is intersected by a transverse passage (42) in which the wedge (14) is slidably positioned. The wedge (14) is drawn into tight engagement with the cable by the bolt (16) entering the transverse passage (42) on an opposite side of the axial passage (22).

5 Claims, 5 Drawing Sheets

ELECTRICAL CABLE CONNECTION DEVICE

FIELD OF THE INVENTION

The present invention relates to a device for use in splicing cables together or terminating a single cable for clamping and securing the cables or cable in a body member.

BACKGROUND OF THE INVENTION

U.S. Pat. No. 4,795,365 discloses a device which includes a body member having axial extending apertures in each end face and transversely extending passages intersecting the apertures. Wedge members, having threaded ends are positioned in the transverse passages with the threaded ends extending out of the body member for receiving nuts so that the wedge members can be drawn tightly in the passages and thereby securely wedge the cables inserted into the apertures. Although this device provides a reliable means for splicing cables, its use requires a hand wrench only whereas electrical utility linemen prefer to use impact wrenches.

It is therefore desirable to provide a device similar to the above type but for use with impact wrenches.

SUMMARY OF THE INVENTION

According to the invention, an electrical cable connection device is provided which includes a body member having an axial passage therethrough and a transverse passage intersecting the axial passage. The device further includes a wedge slidably positioned in the transverse passage and having slanted surfaces which are in direct alignment with the axial passage. A bolt is threadedly engaged with the wedge so that the wedge can be drawn into engagement with a cable positioned in the axial passage.

DESCRIPTION OF THE INVENTION

Figure 1:
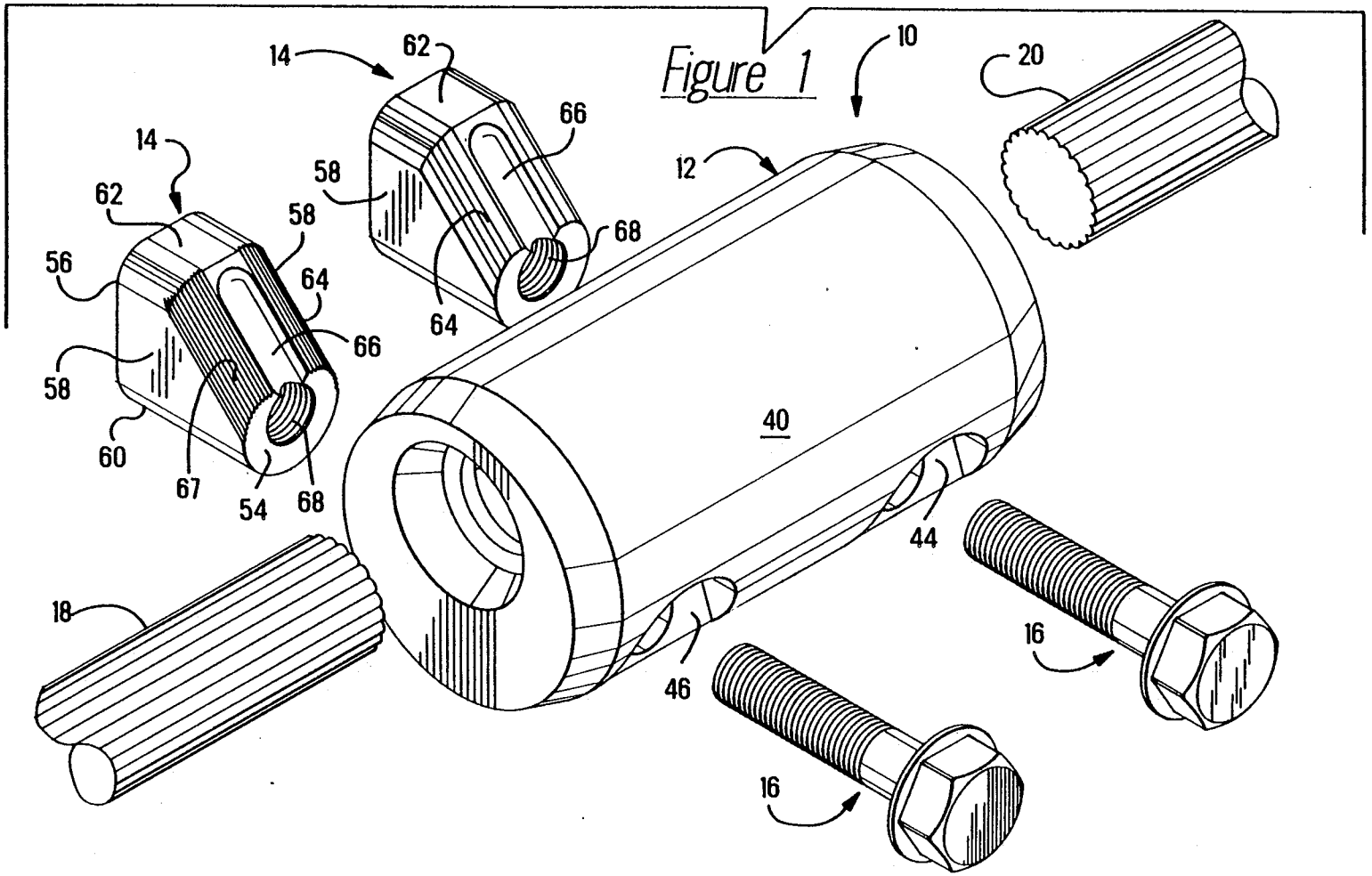
FIG. 1 is a perspective view of an electrical cable connection device constructed in accordance with the present invention and useful in splicing a pair of in-line cables.

With reference to FIG. 1, electrical cable connection device 10 includes body member 12, wedges 14 and bolts 16. The utility of device 10 is to mechanically secure and electrically common a pair of cables 18,20.

Figure 2:
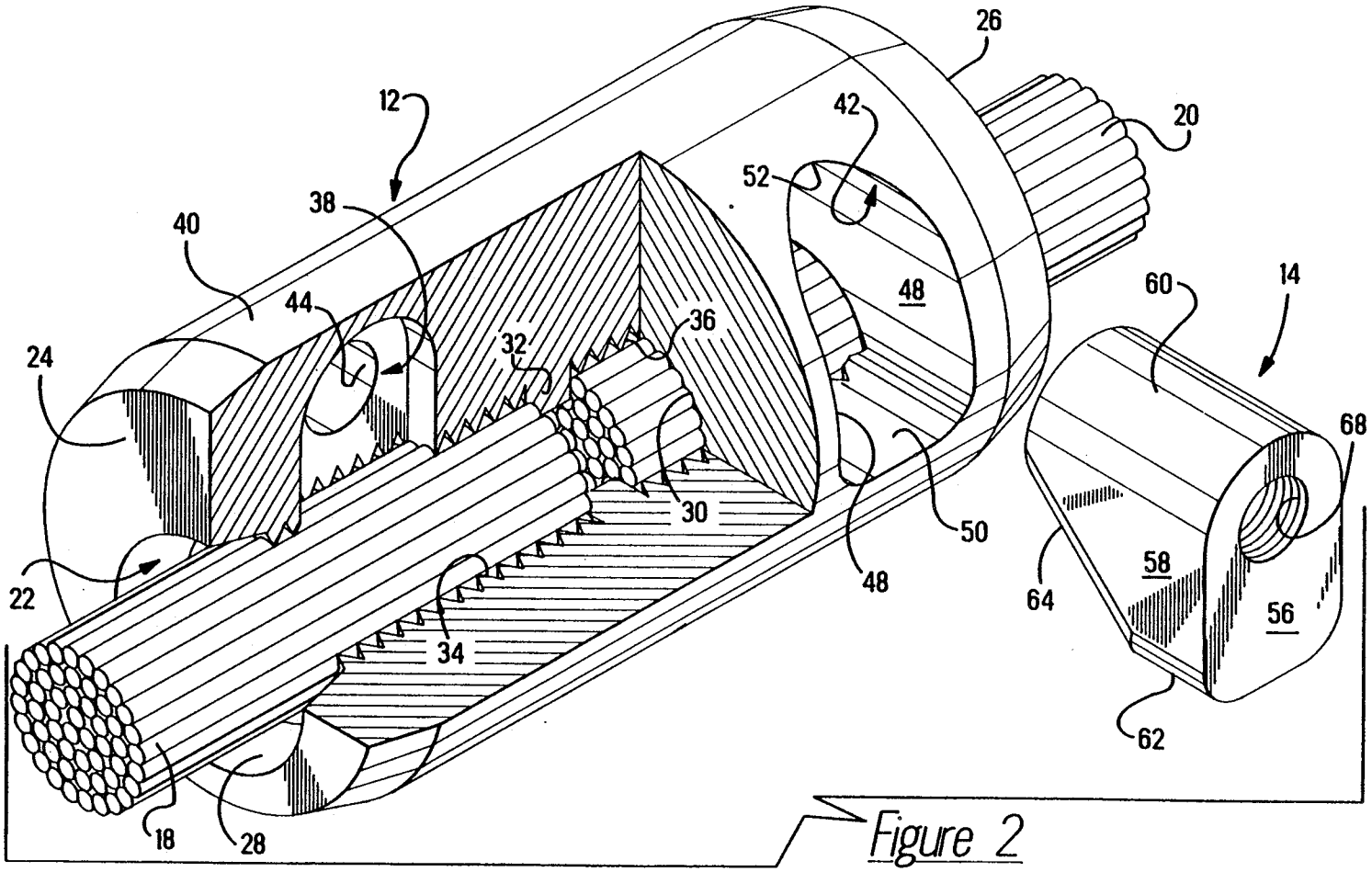
FIG. 2 is a partly sectioned, perspective view of the device of FIG. 1 showing internal details.

With reference to FIG. 2, body member 12, which is shown therein axially rotated 180 degrees relative to FIG. 1, is provided with an axial passage 22, opening onto respective end surfaces 24,26. Passage 22 is subdivided into left and right sections 28,30 respectively with cable stop 32 located therebetween. Section 28 is provided with grooves 34 and section 30 is provided with grooves 36.

Body member 12 is further provided with a pair of transverse passages 38 with each passage 38 intersecting a respective section 28,30 and opening onto diametrical locations on outer surface 40.

Figure 3:
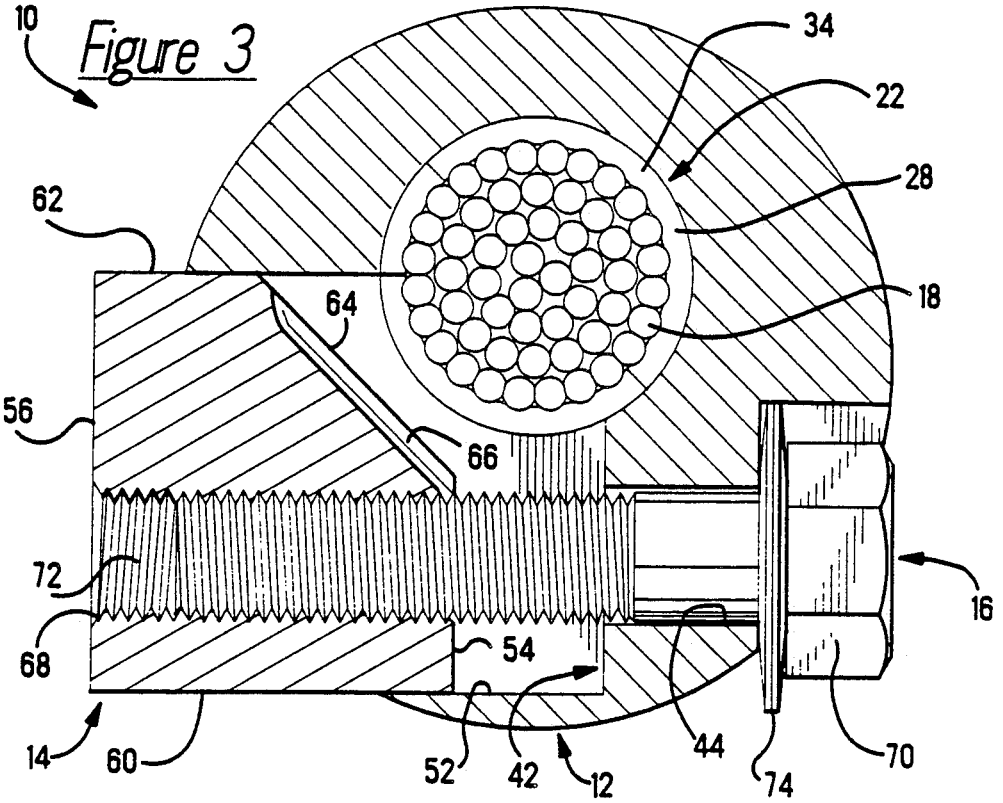
FIGS. 3 and 4 are sectioned end views showing the steps in securing a cable in the device of FIG. 1.

With reference to FIG. 3 also, a given passage 38 includes an enlarged section 42 which intersects axial passage 22 and a transition section 44 which communicates with a surface notch 46. Enlarged section 42 includes parallel side walls 48, floor 50 and a curved roof 52.

Body member 12 is preferably made from 6061-T-6 aluminum or a 356-T-6 cast aluminum.

Wedge 14, as shown in FIG. 1 has an outside surface including opposing end surfaces 54,56, parallel side surfaces 58, rounded first surface 60, opposite second surface 62 and a slanted surface 64 extending between end surface 54 and second surface 62. Groove 66 is provided in slanted surface 64, opening onto end surface 54 but terminating short of surface 62. Further, teeth 67 may be provided on surface 64 as shown on one wedge 14. Wedge 14 is further provided with threaded bore 68 which opens onto both end surfaces 54,56. Wedge 14 is conformably and slidingly received in enlarged section 42 of transverse passage 38.

Bolt 16 includes hexagonal head 70, threaded shank 72 and a washer; e.g., a Bellville type spring washer 74.

As shown in FIG. 3, wedges 14 are positioned in enlarged section 42 with end surfaces 54 facing inwardly and slanted surfaces 64 in direct alignment with respective sections 28,30 of axial passage 22. Shanks 72 on bolts 16, entering enlarged section 42 through transition sections 44, threaded into bores 68. Hexagonal heads 70 and washers 74 are positioned in notches 46 so that on rotating bolts 16, wedges 14 are moved into or out of enlarged sections 42.

Figure 4:
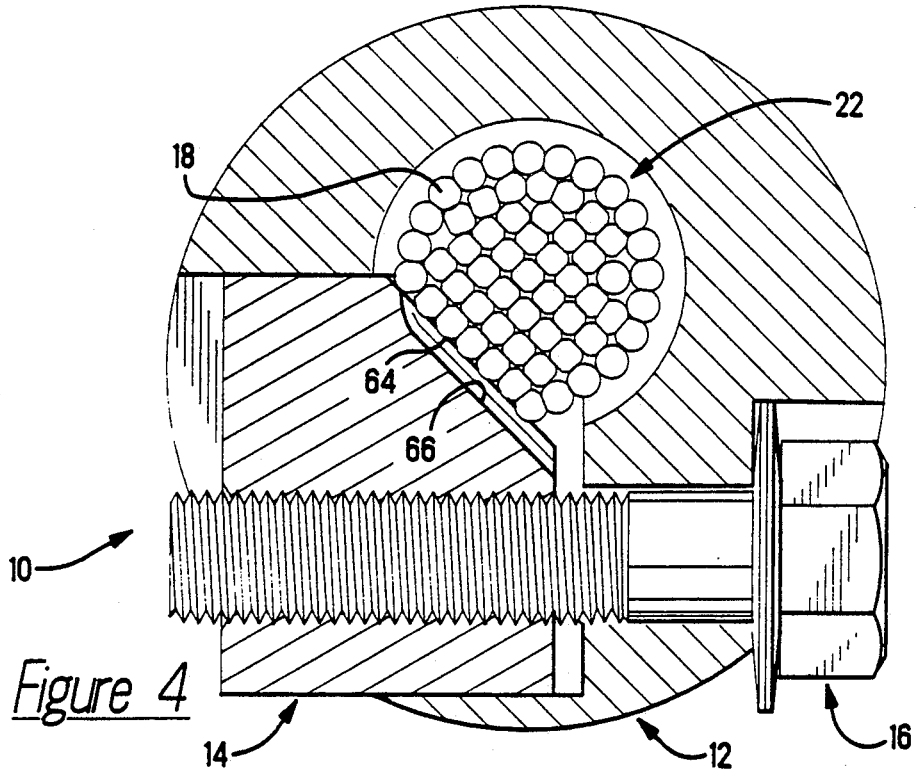

With device 10 assembled as shown in FIG. 3, cables 18,20 are inserted into respective sections 28,30 of passage 22. Bolts 16 are then rotated to bring wedges 14 into securing engagement with respective cables 18,20 as shown in FIG. 4. Grooves 66 provide space into which strands of cables 18,20 may protrude.

Figure 5:
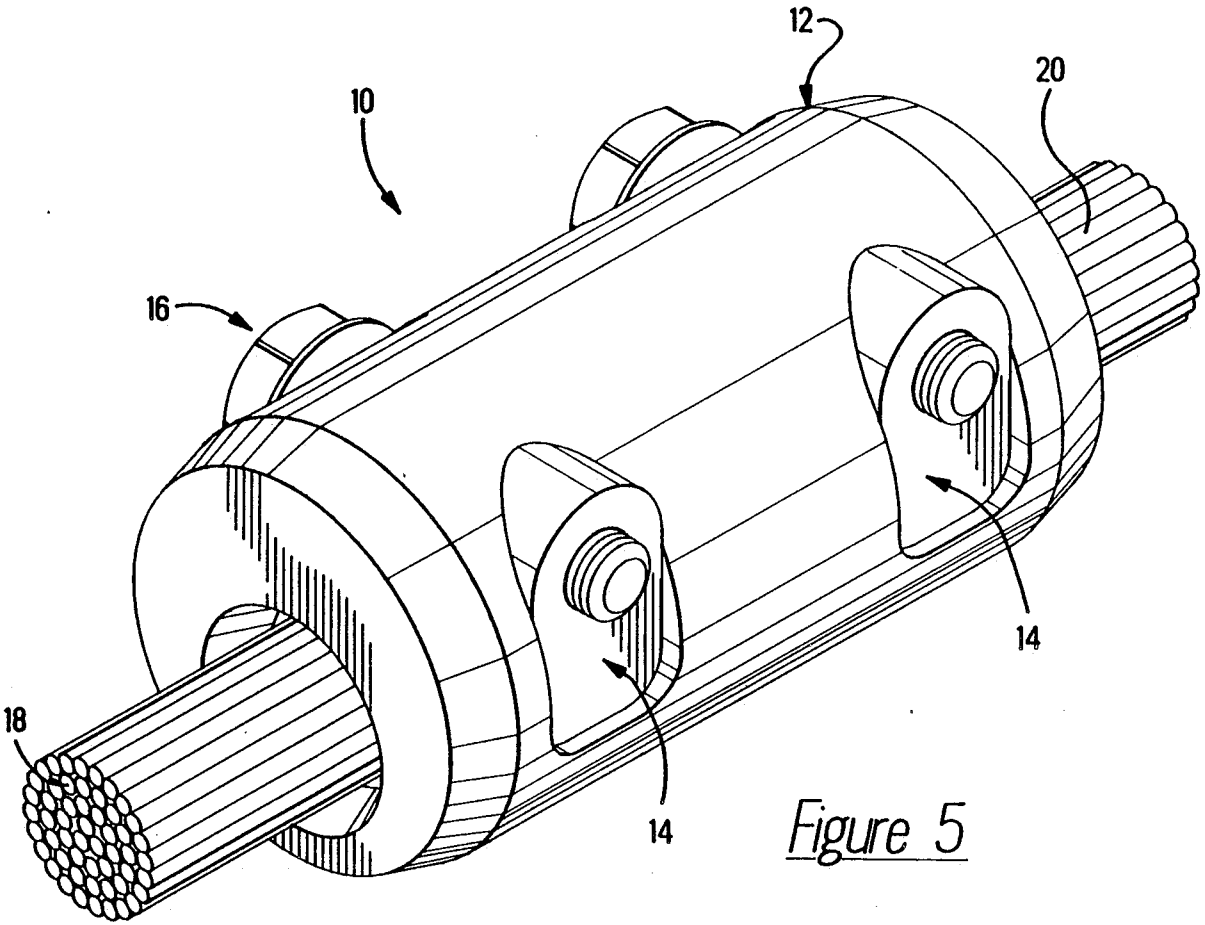
FIG. 5 is a perspective view of the device of FIG. 1 with a pair of cables spliced together therein.

FIG. 5 shows cables 18,20 secured and commoned in device 10.

Disassembly simply requires backing wedges 14 away from respective sections 28,30 by rotating bolts 16 counterclockwise and then axially rotating device 10 counterclockwise to back cables 18,20 out from body member 12.

Figure 6:
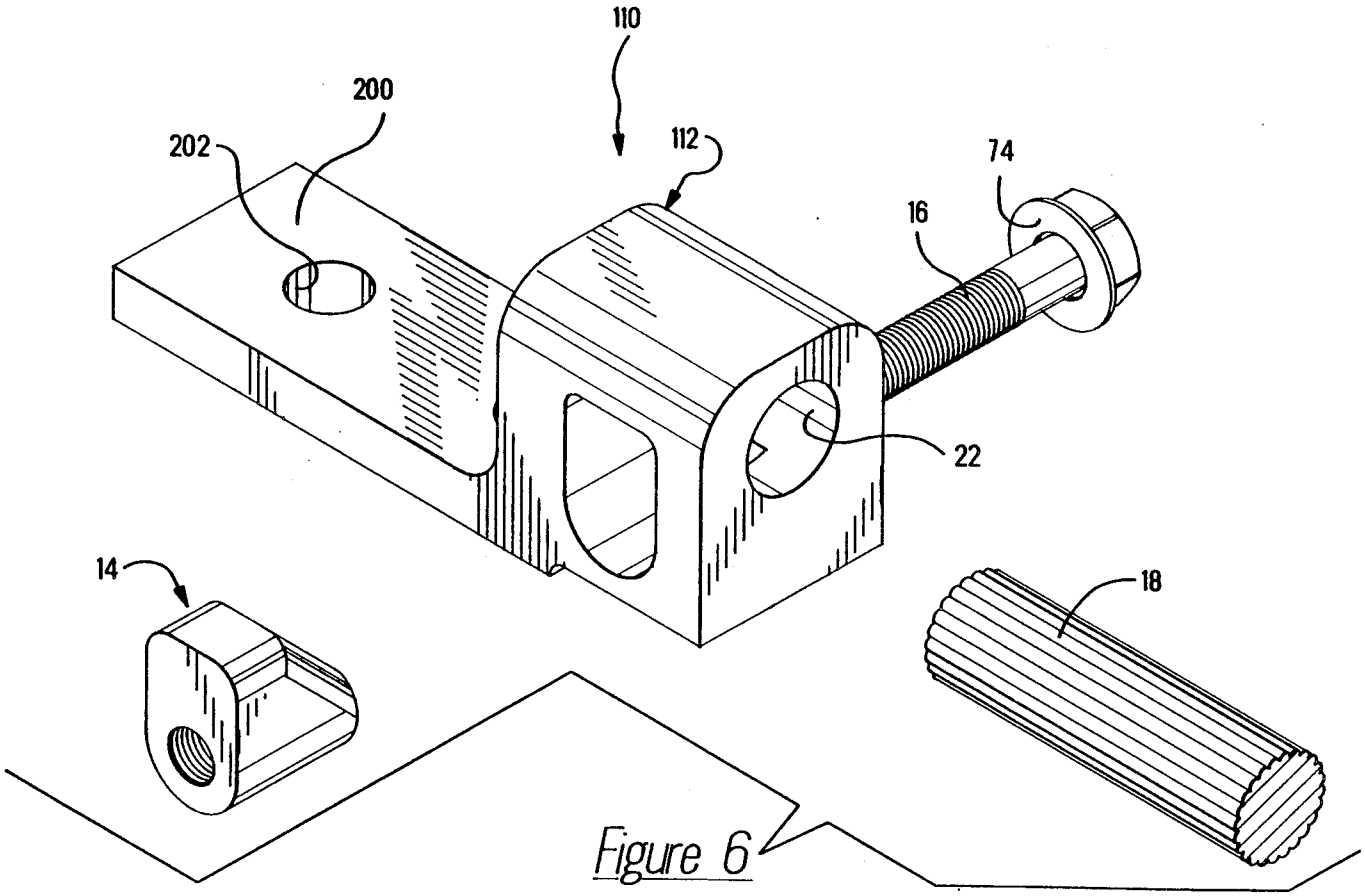
FIG. 6 is a perspective view of an electrical cable connection device useful for terminating a single cable.

FIG. 6 illustrates an electrical cable connection device 110 which is useful for terminating a single cable 18. Device 110 includes body member 112 which is provided with axial passage 22 and a single transverse passage 38 which intersects passage 22. Body member 112 further includes flat blade 200 which is provided with stud receiving hole 202. Device 110 further includes wedge 14, bolt 16 and washer 74.

With the exception of body member 112 having a blade 200 and being adapted to terminate a single cable, device 110 is identical in all other respects to device 110 and functions in exactly the same manner.

As can be discerned from the foregoing, an electrical cable connection device for splicing of two cables or terminating a single cable has been disclosed. The device includes a body member having an axial passage for receiving the cables or cable to be commoned or terminated. The body member further includes one or more transverse passages for receiving one or more wedges which are drawn in against the one or more cables by bolts extending into threaded bores in the wedges from opposite sides of the body member.

We claim:

1. An electrical cable connection device comprising:

a body member having an axial passage extending therethrough for receiving a cable and a transverse passage intersecting said axial passage;

a wedge slidably positioned in one end of said transverse passages and having a slanted surface facing said axial passage; and a bolt, rotatably positioned in an opposite end of said transverse passage, threadedly engaging said wedge so that upon rotating said bolt, said wedge advances towards said axial passage whereby said slanted surface engages a cable which may be positioned therein.

2. The device according to claim 1, wherein a lengthwise groove is provided on said slanted surface of said wedge.

3. An electrical cable connection device for in-line splicing of a pair of cables, comprising:

a body member having an axial passage extending therethrough and a pair of spaced apart transverse passages intersecting said axial passage;

a wedge slidably positioned in one end in each of said transverse passage, said wedges having a slanted surface facing said axial passage; and a bolt, rotatably positioned in an opposite end in each of said transverse passages, threadedly engaging a respective wedge to cause said wedges to slide towards and away from said axial passage.

4. The device according to claim 3 wherein said slanted surface on said wedges include a lengthwise-extending groove.

5. The device according to claim 4 wherein teeth are provided on the surface of said axial passage.

* * * * *